United States Patent [19]

Rabinovich et al.

[11] 3,978,907

[45] Sept. 7, 1976

[54] METHOD OF ELECTROSLAG REMELTING BY MELTING MAIN AND ADDITIONAL ELECTRODES AND MACHINE FOR EFFECTING SAID METHOD

[76] Inventors: Volf Iudovich Rabinovich, ulitsa Gagarina, 74, kv. 27; Jury Nikolaevich Kriger, ulitsa Oktyabrskaya, 3, kv. 59, both of Chekhov Moskovskoi oblasti; Igor Alexandrovich Svitenko, Teply Stan, 5 mikroraion, korpus 61, kv. 149, Moscow; Viktor Evgenievich Sapunov, ulitsa Gagarina, 52, kv. 44; Vyacheslav Vasilievich Filippov, 7 kvartal, 10, kv. 36, both of Chekhov Moskovskoi oblasti, all of U.S.S.R.

[22] Filed: Mar. 24, 1975

[21] Appl. No.: 561,074

[52] U.S. Cl. ..... 164/52; 164/252
[51] Int. Cl.[2] ..... B22D 27/02
[58] Field of Search ..... 164/52, 252

[56] References Cited

UNITED STATES PATENTS

| | | | |
|---|---|---|---|
| 2,369,233 | 2/1945 | Hopkins | 164/52 |
| 3,587,715 | 6/1971 | Holzgruber | 164/252 |
| 3,608,618 | 9/1971 | Maskall | 164/252 |
| 3,921,698 | 11/1975 | Grof et al. | 164/52 |

*Primary Examiner*—Francis S. Husar
*Assistant Examiner*—John E. Roethel
*Attorney, Agent, or Firm*—Holman & Stern

[57] ABSTRACT

A machine in which there is provided a mold mounted on a base plate, a main electrode and an additional consumable electrode and a power supply source connected to the additional electrode and coupled by means of a switch alternately either with the main electrode or with the mold. To effect the remelting process in the above machine, the additional electrode, insulated from the mold, is introduced into the lower portion of the mold melting space, after which a part of the mold melting space is filled with molten slag, the power supply source is connected to the mold and a metal bath is established on the additional electrode; then the main electrode is introduced into the slag bath, the power supply source is disconnected from the mold and connected to the main electrode and melting continues until a casting is melted.

2 Claims, 1 Drawing Figure

METHOD OF ELECTROSLAG REMELTING BY MELTING MAIN AND ADDITIONAL ELECTRODES AND MACHINE FOR EFFECTING SAID METHOD

BACKGROUND OF THE INVENTION

The present invention relates to electrometallurgy and more particularly to electroslag remelting methods and machines for effecting the same.

The invention may prove to be most advantageous in producing intricate shaped castings which should meet more stringent requirements as to their quality, such as, rolls for rolling mills, covers for power plant fittings, intended to replace forged and welded elements of similar designation.

PRIOR ART

Known in the art is a method of electroslag remelting by melting both a main electrode and an additional cconsumable electrode, wherein the two electrodes the main electrode and the additional electrode, are introduced into the mold melting space, a part of the space is filled with slag and an electric current is passed therethrough.

In the above method, the slag bath through which the electric current flows is heated mainly in the space between the main and additional electrodes. However, in this prior-art procedure, both the main and additional consumable electrodes are cut-in into an electric circuit in series and the passage of electric current therethrough results in substantial electrical losses which adversely affect the amount of heat liberated in the slag.

Therefore, when in melting an intricate shaped casting, it is necessary to provide a high-quality fusion between the lower part of the casting and another part, the method is ineffective, since it does not ensure a high-grade fusing of that part of the casting owing to an inadequate amount of heat released in the slag at the juncture.

OBJECTS AND SUMMARY OF THE INVENTION

The main object of the invention is to provide a method of electroslag remelting by melting a main electrode and an additional electrode which ensures a high-quality fusing of a casting part (additional electrode) to the casting being melted.

Another object of the invention is the provision of an electroslag melting machine which allows a high-quality fusion of a casting part (additional electrode) to the casting being melted.

To accomplish the foregoing and related ends, said invention resides in a method of electroslag remelting by melting both a main electrode and an additional consumable electrode, in which the main and additional consumable electrodes are introduced into a mold melting space, a part of this space is filled with slag and an electric current is passed therethrough and according to the invention, the remelting process is initiated by heating the additional electrode and lasts until said electrode is melted and a metal bath is established, whereupon the main electrode is introduced into the slag and melted therein.

The metal bath established on the additional electrode as well as the subsequent melting of the main electrode ensure a high-quality fusing of the additional electrode to the casting being melted.

The present invention results in the provision of an electroslag remelting technique envisaging the melting of both electrodes, the main electrode and the additional electrode, and allowing a high-quality fusing of the additional electrode to the casting being melted.

For effecting the above method, there is provided a machine, comprising a cooled mold, a base plate mounting said mold, a main electrode, an additional electrode and a power supply source associated electrically with the main and additional electrodes.

According to the invention, the power supply source is associated, through a switch with either the main electrode or with the mold and the mold is mounted through an electric insulating lining on the base plate, through which passes the additional electrode connected to another power source pole.

The connection of the power supply source to the additional electrode and directly to the mold, bypassing the main electrode, increases the magnitude of electric current flowing through the slag bath over that obtained in a circuit in which the power supply source is connected to the additional and main electrodes; this results in a more intense heating of the slag bath thus melting the additional electrode and ensuring a high-quality fusing of the additional electrode to the casting being melted as the power supply source is subsequently switched over from the mold to the main electrode which is melted off.

The present electroslag remelting machine makes it possible to radically enhance the quality of fusing of the additional electrode to the casting being melted without any considerable extra outlays for modernization of the existing equipment.

The nature of the invention will be clear from the following detailed description of a particular embodiment to be had in conjunction with the accompanying drawing in which:

DETAILED DESCRIPTION OF A PREFERRED EMBODIMENT

Figure 1:
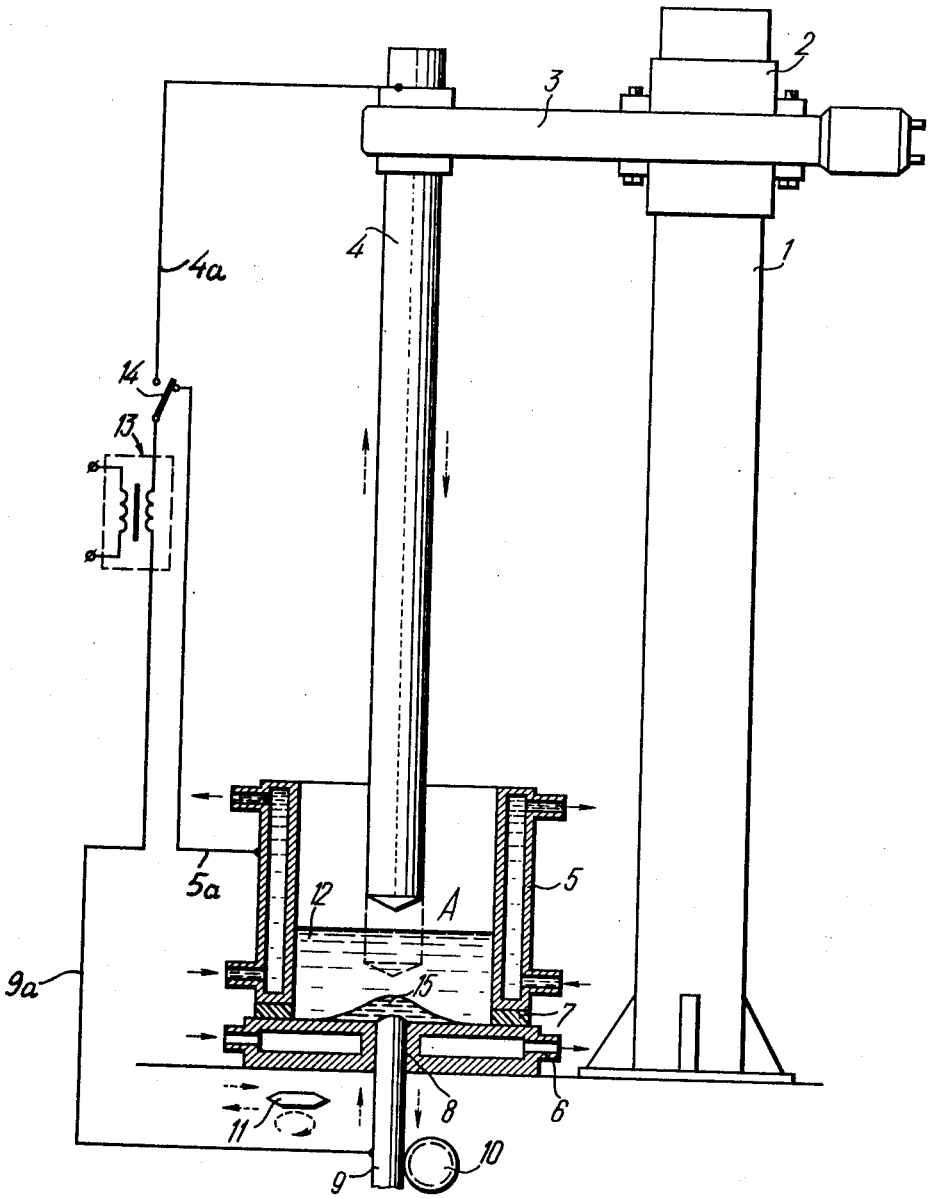
FIG. 1 is a view in elevation and partly in section of the electroslag remelting machine, according to the invention.

Moving vertically along a mast 1 of the machine is a carriage 2 mounting a clip 3 adapted for gripping and holding in place a main electrode 4 which is introduced into a melting space A of a cooled mold 5. The mold 5 is set up on a base plate 6 with an electric insulating lining 7 being located between the mold and base plate. The base plate 6 is provided with a hole 8 into which an additional consumable electrode 9 is introduced.

The machine is equipped with a gear 10 for transferring the additional electrode 9 and with a gear 11 for severing the electrode 9. The melting space A of the mold 5 accommodates molten slag 12.

A power supply source 13 is connected to the additional electrode 9 via line 9*a* and the main electrode 4 via line 4*a*, with the circuit between the power supply source 13 and the main electrode 4 including a switch 14 which makes it possible to disconnect the main electrode 4 from the power supply source 13 and to connect the mould 5 thereto via line 5*a*.

Solid arrows in the drawing show the movement of a coolant for the base plate 6 and the mold 5, while dotted arrows indicate the direction of movement of the main electrode 4, the additional electrode 9 as well as the direction of rotation and transfer of the severing gear 11.

The machine operates in the following manner:

The additional consumable electrode 9 is introduced through the hole 8 in the base plate 6 and the molten slag 12 is poured therein.

Next, the power supply source 13 is connected to the mold 5 and the additional electrode 9 by actuation of the switch 14.

The electric insulating lining 7 placed between the mold 5 and the base plate 6 precludes the passage of electric current through the base plate 6 with the ensuring current circuit established between the mold wall and the additional electrode through the molten slag 12.

As the additional electrode 9 is heated and melted with the ensuing formation of a molten metal bath 15, the main electrode 4 is introduced into the molten slag 12 (as shown in the drawing by a dotted line), the mold 5 is disconnected from the power supply source 13 by actuation of the switch 14 and the main consumable electrode 4 is connected thereto. With the electrodes being in this position, the electroslag remelting process continues until it is completed.

The cutting gear 11 is employed for severing the requisite section of the additional electrode fused to the casting, and the electrode transfer gear 10 carries the remaining portion of the additional electrode 9 into the hole 8 in the base plate 6 for effecting the next heat.

The invention is not to be confined to any strict conformity to the showings in the drawings but changes or modifications may be made therein so long as such changes or modifications mark no material departure from the spirit and scope of the appended claims.

We claim:

1. A method of electroslag remelting by melting a main electrode and an additional consumable electrode in a mold having a melting space, comprising the steps of introducing said main and additional consumable electrodes into the melting space of said mold, filling a part of the melting space of said mold with slag, cutting-in said mold and additional consumable electrode into an electric current circuit through the slag, heating the additional consumable electrode until it melts off and a metal bath is established, introducing said main consumable electrode into the slag, disconnecting said mold from the current circuit, cutting-in said main electrode into the electric circuit and its melting, and continuing the electroslag remelting process until completion.

2. A machine for electroslag remelting by melting a main electrode and an additional consumable electrode in a mold filled with slag, said machine comprising: a cooled mold, means mounting the main and additional consumable electrodes in said mold; a power supply source, a switch for associating the power supply source electrically alternately with said mold and main electrode; a base plate through which passes said additional electrode, said additional electrode being connected to another pole of said power supply source, and an electric insulating lining between the base plate and mold so that when said power supply source is energized and an electric current flows through said additional electrode, the additional electrode is heated and melts off establishing a metal bath, and when said main electrode is introduced into the slag and the electric current is switched over from said mold to the main electrode, it is heated until melting, ensuring a strong juncture between said main and additional electrodes.

* * * * *